US006802738B1

(12) United States Patent
Henningsen

(10) Patent No.: US 6,802,738 B1
(45) Date of Patent: Oct. 12, 2004

(54) CONNECTOR FOR COAXIAL CABLE WITH MULTIPLE START THREADS

(75) Inventor: Jimmy Ciesla Henningsen, Naestved (DK)

(73) Assignee: Corning Gilbert Inc., Glendale, AZ (US)

( * ) Notice: Subject to any disclaimer, the term of this patent is extended or adjusted under 35 U.S.C. 154(b) by 545 days.

(21) Appl. No.: 09/359,916

(22) Filed: Jul. 26, 1999

(30) Foreign Application Priority Data

Jul. 24, 1998 (EP) ..... 98113869

(51) Int. Cl.[7] ..... H01R 9/05
(52) U.S. Cl. ..... 439/583; 439/578
(58) Field of Search ..... 439/578, 579, 439/580, 581, 582, 583, 584, 585; 385/78, 82

(56) References Cited

U.S. PATENT DOCUMENTS 5,352,134 A * 10/1994 Jacobsen et al. ..... 439/584
5,360,239 A * 11/1994 Klementich ..... 285/94
5,651,698 A * 7/1997 Locati et al. ..... 439/578
5,852,695 A * 12/1998 Elliman et al. ..... 385/52

FOREIGN PATENT DOCUMENTS

| | | |
|---|---|---|
| DE | 38 28 953 | 3/1990 |
| FR | 2 224 894 | 10/1974 |
| FR | 2 272 505 | 12/1975 |
| WO | WO 97 22162 | 6/1997 |

* cited by examiner

*Primary Examiner*—Alexander Gilman
(74) *Attorney, Agent, or Firm*—Marvin A. Glazer; Joseph M. Homa

(57) ABSTRACT

Cable connector for coaxial cable, comprising a bushing (2) for providing an axial displacement of parts (4,5,6,7,8) in the connector, whereby these parts are brought into mechanical and/or electrical engagement with the coaxial cable. The axial displacement is provided by screwing a thread (10) provided on the bushing (2) onto a corresponding thread (9) provided on the main body (1) of the connector. By providing said threads (9,10) as multiple-start threads, the assembly time can be substantially reduced.

2 Claims, 1 Drawing Sheet

CONNECTOR FOR COAXIAL CABLE WITH MULTIPLE START THREADS

BACKGROUND OF THE INVENTION

Field of the Invention

Figure 1:
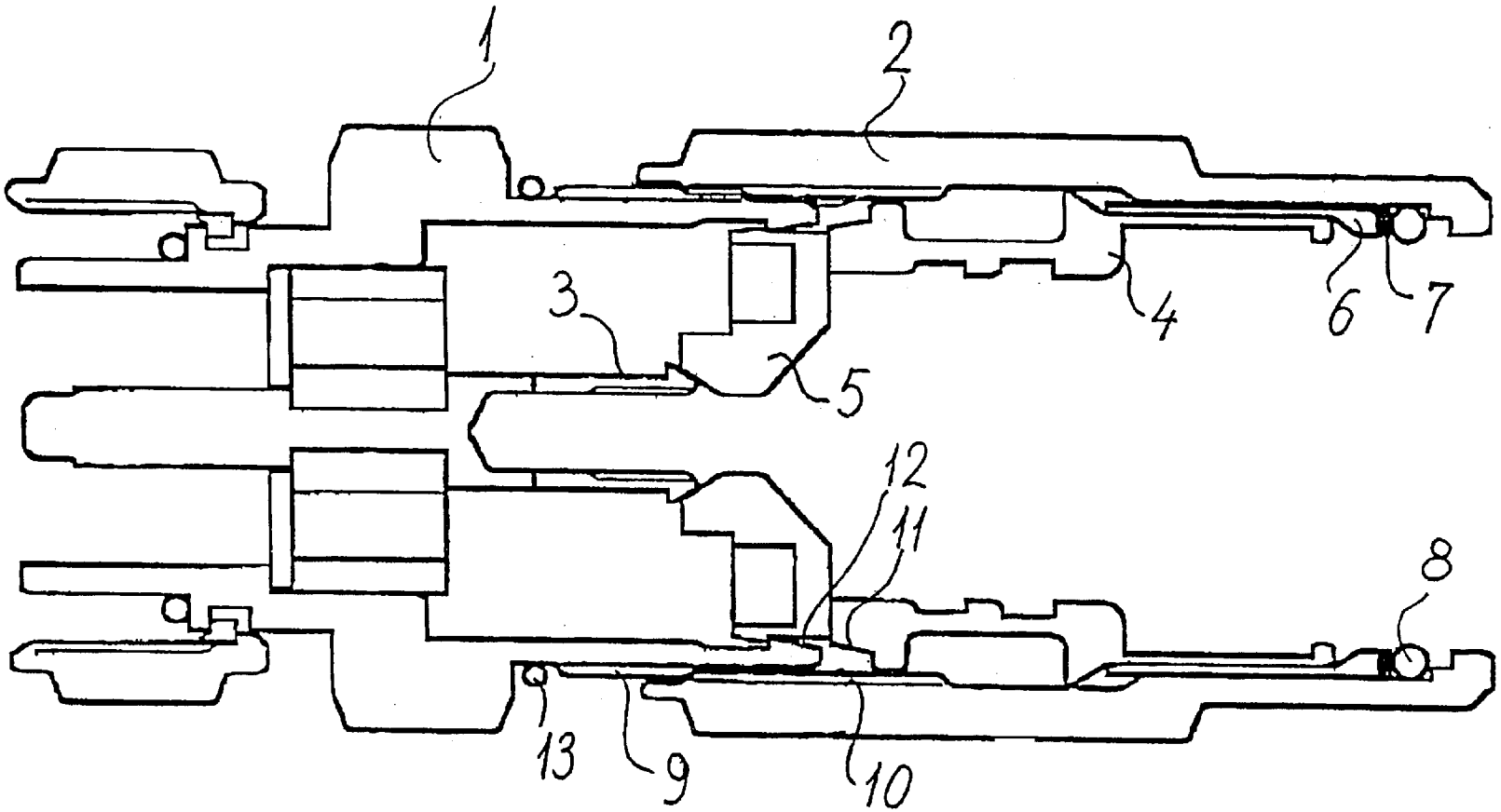

The present invention relates generally to a coaxial cable connector, and more particularly, to a coaxial cable connector of the type including a main body and a screw-on bushing or collar.

In cable connectors of this kind it is known to use axially displaceable components with conical formations coorperating to provide the radial compression of axially slotted connecting parts, to provide the electrical and mechanical connections between the connector and the coaxial cable. The axial displacement of parts in the connector is effected by a bushing or collar provided with a thread, which is screwed onto a corresponding thread provided in the main body of the connector. Due to the necessary many rotations of the bushing the mounting time for such connectors is high. It is known to eliminate this high mounting time by using a connector mounting method involving crimping the connector with a crimping tool, but such connectors cannot be replaced in a simple way, due to the inevitable damage on the cable when removing such a crimped cable connector.

It is the object of the present invention to provide a cable connector of the above kind, with which the mounting time can be reduced.

SUMMARY OF THE INVENTION

Briefly described, the present invention is a cable connector for a coaxial cable which includes a main body and an outer bushing that threadedly engages the main body. The connector includes an axially slotted, axially displaceable ferrule through which the end of the coaxial cable is passed; when such ferrule is radially compressed, the ferrule serves to make an electrical connection with the outer conductor of the coaxial cable, and also serves to grasp the outer jacket of the coaxial cable. The coaxial cable connector further includes an axially displaceable inner bushing that is axially displaced as the outer bushing is threaded onto the main body of the connector. The inner bushing, in turn, axially displaces and radially compresses the ferrule as the outer bushing is threaded onto the main body of the connector. The main body and outer bushing of the connector incorporate multiple-start threads whereby the outer bushing can be brought to a final mounting position upon the main body with only a relatively small degree of rotation of the outer bushing, thereby reducing mounting time. The ferrule also preferably includes a locking arrangement for engaging a mating locking arrangement on the main body of the connector once the ferrule has been axially displaced in order to prevent rotation of the ferrule or the coaxial cable as the outer bushing is tightened onto the main body of the connector. In the preferred embodiment of the present invention, O-rings are provided to form a liquid and moisture tight connector.

In the following detailed portion of the present description the present invention will be explained in more detail with reference to the exemplary embodiment of a cable connector for coaxial cable according to the invention shown in the drawing in which FIG. 1 shows an axial cut through a cable connector for coaxial cable in accordance with the invention.

The cable connector for coaxial cable shown in the figure comprises a main body 1, which, as shown to the left in the drawing, is provided with a plug part in the form of a BNC, TNC or the like. This plug part is not part of the invention and any suitable connection may be provided in this place. The main body 1 is provided with threads 9 for engagement with corresponding threads 10 on a bushing or collar 2. Centrally placed in the main body 1 is an axially slotted tube 3 for connection of the central conductor of the coaxial cable. The axially slotted tube 3 will be radially compressed by an axially displaceable insulating part 5 which is provided with a conical formation for engaging the axially slotted tube 3. An axially slotted ferrule 4 for electrical connection to the outer conductor of the coaxial cable and possibly for mechanical connection to the outer insulating jacket of the cable is placed behind the axially displaceable part 5 and the axial displacement of the ferrule 4 and the axially displaceable part 5 is provided by screwing the bushing 2 onto the main body 1 whereby the bushing moves an axially displaceable inner bushing 6 acting upon the ferrule 4. In the embodiment shown a disc 7 and a O-ring 8 is placed between a step on the bushing 2 and the inner bushing 6. A further O-ring 13 is provided on the main body 1 for providing a sealing between the bushing 2 and main body 1 when the bushing 2 is brought into its final position.

The cable connector shown in the drawing functions in the following way:

A prepared coaxial cable is inserted into the connector, the cable being prepared in such a way, that the inner conductor can be inserted into the axially slotted tube 3 and the outer conductor and outer jacket can be positioned inside the ferrule 4. The bushing 2 is screwed onto the main body 1 using the threads 9 and 10, whereby the bushing moves the disc 7, the axially displaceable inner bushing 6, the axially slotted ferrule 4 and the axially displaceable insulating part 5 whereby the axially slotted tube 3 is compressed radially into contact with the central conductor of the coaxial cable. The ferrule 4 is provided with a locking arrangement 11 which at the end of the axial travel of the ferrule 4 is brought into engagement with a corresponding locking arrangement 12 provided on the main body 1. The engagement between the two locking arrangements 11,12 prevents the ferrule 4 from rotating relative to the main body 1. Further axial movement of the bushing 2 will provide an axial movement of the inner bushing 6, whereby the axially slotted ferrule 4 will be radially compressed due to appropriate conical formations on the ferrule 4 cooperating with the inner bushing 6, whereby the ferrule 4 is brought into engagement with the outer conductor and the outer jacket on the coaxial cable. In the embodiment shown part of the radial compression of the ferrule 4 is provided by engagement between the front of the inner bushing 6 and a conical formation of the ferrule and other part of the radial compression of the ferrule is provided by engagement between a conical formation on the inner bushing 6 and the back part of the ferrule 4.

Above the present invention has been described in connection with a specific embodiment of the invention, however it will be clear for a man skilled in the art, that many alterations can be made without departing from the following claims.

What is claimed is:

1. A cable connector for terminating the end of a coaxial cable, the coaxial cable including a center conductor, an outer conductor, and an outer jacket, said cable connector comprising:

a. a main body having external threads;

b. an outer bushing including internal threads that threadedly engage the external threads of said main body for securing said outer bushing to said main body;

c. a ferrule disposed within said outer bushing for axial displacement therein, said ferrule having a bore for receiving the end of the coaxial cable, said ferrule including at least one axial slot for allowing said ferrule to be radially compressed for making an electrical connection with the outer conductor of the coaxial cable, and for grasping the outer jacket of the of the coaxial cable;

d. an axially displaceable inner bushing disposed within said outer bushing, said inner bushing being axially displaced as the outer bushing threadedly engages said main body of the connector, and wherein said inner bushing, in turn, axially displaces and radially compresses said ferrule as the outer bushing threadedly engages said main body of the connector; and e. the external threads of said main body and the internal threads of said outer bushing comprising multi-start threads for allowing said outer bushing to be brought to a final mounting position upon said main body with only a relatively small degree of rotation of said bushing to reduce mounting time, wherein:

a. said main body has first and second opposing ends, the first end having a conductive pin extending therefrom for electrical coupling to the center conductor of the coaxial cable, and the second end of said main body having said external threads formed thereon; and b. said ferrule has first and second opposing ends, said ferrule initially being rotatable within said outer bushing before said outer bushing threadedly engages the main body of the connector, the first end of said ferrule extending into the second end of the main body as said outer bushing is threaded onto said main body, the first end of said ferrule non-rotatably engaging the second end of said main body in locking engagement as said outer bushing is threaded onto said main body, whereby said ferrule and the coaxial cable are prevented from rotating relative to said main body.

2. The cable connector recited by claim 1 and further comprising a first O-ring disposed between said main body and said outer bushing, and a second O-ring disposed between said outer bushing and the coaxial cable for providing a moisture-tight connector.

* * * * *